US011559142B2

(12) United States Patent
Blatt et al.

(10) Patent No.: US 11,559,142 B2
(45) Date of Patent: Jan. 24, 2023

(54) BEDDING SECUREMENT SYSTEM

(71) Applicants: Kyle Parker Blatt, Laguna Beach, CA (US); Christina Katherine Blatt, Mount Prospect, IL (US)

(72) Inventors: Kyle Parker Blatt, Laguna Beach, CA (US); Christina Katherine Blatt, Mount Prospect, IL (US)

( * ) Notice: Subject to any disclaimer, the term of this patent is extended or adjusted under 35 U.S.C. 154(b) by 0 days.

(21) Appl. No.: 17/195,639

(22) Filed: Mar. 9, 2021

(65) Prior Publication Data

US 2022/0287468 A1 Sep. 15, 2022

(51) Int. Cl.
*A47C 21/02* (2006.01)

(52) U.S. Cl.
CPC ..... *A47C 21/022* (2013.01)

(58) Field of Classification Search
CPC ..... A47C 21/00; A47C 21/02; A47C 21/022
See application file for complete search history.

(56) References Cited

U.S. PATENT DOCUMENTS 5,003,655 A * 4/1991 Kafai ..... A47G 9/0238 5/497
6,886,197 B1 * 5/2005 Madigan ..... A47G 9/02 5/493
7,051,387 B1 * 5/2006 Yoder ..... A47G 9/086 5/413 R
D713,655 S 9/2014 Blatt et al.
9,247,835 B2 2/2016 Blethen et al.
9,265,368 B2 2/2016 Blethen et al.
D792,124 S 7/2017 Blatt et al.
2003/0177579 A1 * 9/2003 Diak/Ghanem ..... A47G 9/02 5/484
2004/0128764 A1 * 7/2004 McGrath ..... A47C 27/005 5/498
2006/0053553 A1 * 3/2006 Gomeh ..... A47G 9/02 5/502
2008/0216238 A1 * 9/2008 Tatsuno ..... A47G 9/086 5/420
2009/0293195 A1 * 12/2009 McGrath ..... A47C 21/022 5/482
2012/0204348 A1 * 8/2012 Bayer ..... A47G 9/08 5/413 R
2013/0192001 A1 * 8/2013 Rensink ..... A47C 31/00 5/691
2016/0120328 A1 * 5/2016 Wang ..... A47C 21/022 24/72.5
2018/0055238 A1 * 3/2018 Emile ..... A47C 21/02
2018/0192780 A1 * 7/2018 Lowe ..... A47C 21/022
2020/0128967 A1 * 4/2020 Cote ..... A47G 9/0238

* cited by examiner

*Primary Examiner* — Robert G Santos
*Assistant Examiner* — George Sun
(74) *Attorney, Agent, or Firm* — McDonnell Boehnen Hulbert & Berghoff LLP

(57) ABSTRACT

A bedding securement system includes a first bedding layer configured to be disposed over a mattress and a flexible base layer configured to be secured under the mattress. The first bedding layer includes a top end, a bottom end, and a plurality of first fasteners disposed along the bottom end. Likewise, the flexible base layer includes a top end, a bottom end, and a plurality of anchoring fasteners disposed along the bottom end. The plurality of anchoring fasteners of the flexible base layer are configured to couple to the plurality of first fasteners of the first bedding layer so as to limit movement of the first bedding layer with respect to the mattress.

10 Claims, 5 Drawing Sheets

BEDDING SECUREMENT SYSTEM

FIELD

The present disclosure is related to bedding, for example for protecting a mattress an covering a person lying on the matters and is more specifically related to a system for securing bedding in place.

BACKGROUND

Bedding, including sheets and blankets, is typically used on beds in order to keep an occupant of the bed warm, to protect the sleeping surface, and to provide an attractive presentation of the bed when it is not in use. Bedding of various different materials and configurations have been used many years. Still, the present inventors have recognized that certain improvements in bedding configurations would be attractive to consumers.

SUMMARY

In a first aspect, the present disclosure provides a bedding securement system comprising:

- a first bedding layer configured to be disposed over a mattress, the first bedding layer including a top end, a bottom end, and a plurality of first fasteners disposed along the bottom end; and
- a flexible base layer configured to be secured under the mattress, the flexible base layer including a top end, a bottom end, and a plurality of anchoring fasteners disposed along the bottom end, wherein the plurality of anchoring fasteners of the flexible base layer are configured to couple to the plurality of first fasteners of the first bedding layer so as to limit movement of the first bedding layer with respect to the mattress.

In some embodiments, the flexible base layer includes a flat body, and each of the anchoring fasteners includes a cord that extends from the flat body at the bottom end of the flexible base layer.

In some embodiments, the flat body is fabric.

In some embodiments, the fabric is a gripping fabric.

In some embodiments, each of the anchoring fasteners of the flexible base layer is configured to couple to a respective one of the first fasteners of the first bedding layer.

In some embodiments, the anchoring fasteners include buttons and the first fasteners are button apertures that extend through a section of the first bedding layer.

In some embodiments, the first bedding layer includes a sheet of fabric, and wherein the button apertures extend through the sheet of fabric.

In some embodiments, the first bedding layer includes a sheet of fabric and an auxiliary flap attached to the sheet of fabric, and wherein the button apertures extend through the auxiliary flap.

In some embodiments, the first bedding layer includes a sheet of fabric and an auxiliary flap attached to the sheet of fabric, and wherein the first fasteners are disposed on the auxiliary flap.

In some embodiments, the auxiliary flap is sewn to the first bedding layer.

In some embodiments, the auxiliary flap is attached to an interior surface of the sheet of fabric.

In some embodiments, the auxiliary flap is attached to an edge of the sheet of fabric.

In some embodiments, the first bedding layer is a top sheet.

In some embodiments, the first bedding layer is a blanket or a bed spread.

In some embodiments, the first bedding layer includes a pocket to hold an insulating layer.

In some embodiments, the bedding securement system further includes a second bedding layer configured to be disposed under the first bedding layer, where the second bedding layer includes a top end, a bottom end, and a plurality of second fasteners disposed along the bottom end. The plurality of second fasteners of the second bedding layer are configured to couple to the plurality of anchoring fasteners of the flexible base layer or the plurality of first fasteners of the first bedding layer so as to limit movement of the second bedding layer with respect to the mattress.

In a second aspect, the disclosure provides a bedding securement system comprising:

- a first bedding layer configured to be disposed over the mattress, the first bedding layer including a top end, a bottom end, and a plurality of second fasteners disposed along the bottom end; and
- a flexible base layer configured to be secured under a mattress, the flexible base layer having a top end and a bottom end and comprising:
  - a fabric body, and
  - a plurality of anchoring fasteners, wherein each of the anchoring fasteners includes a cord extending from the fabric body at the bottom end of the flexible base layer and a button secured to the cord, wherein the plurality of anchoring fasteners of the flexible base layer are configured to couple to the plurality of first fasteners of the first bedding layer so as to limit movement of the first bedding layer with respect to the mattress.

In some embodiments, the anchoring fasteners are buttons and the first fasteners are button apertures that extend through a section of the first bedding layer.

In a third aspect, the disclosure provides a bedding securement system comprising:

- a mattress including a top end, a bottom end, an upper surface, and a lower surface;
- a flexible base layer secured under the mattress, the flexible base layer having a top end disposed under the mattress and a bottom end extending out from the bottom end of the mattress, the flexible base layer comprising:
  - a fabric body engaging a portion of the lower surface of the mattress, and
  - a plurality of anchoring fasteners, wherein each of the anchoring fasteners includes a cord extending from the fabric body at the bottom end of the flexible base layer and a button secured to the cord; and
- a first bedding layer laid over the mattress, the first bedding layer including a top end, a bottom end, and a plurality of first fasteners disposed along the bottom end, wherein the plurality of first fasteners of the first bedding layer are coupled to the plurality of anchoring fasteners of the flexible base layer so as to limit movement of the first bedding layer with respect to the mattress.

In some embodiments, a width of the mattress is greater than a width of the flexible base layer.

These and other aspects of the disclosure will be evident to those of ordinary skill in the art from the following detailed description.

BRIEF DESCRIPTION OF THE DRAWINGS

Certain example embodiments are shown in the following-identified figures and described in detail below. In describing these examples, like or identical reference numbers are used to identify the same or similar elements. The figures are not necessarily to scale and certain features and certain views of the figures may be exaggerated in scale or depicted in schematic form for clarity or conciseness.

DETAILED DESCRIPTION

Unless otherwise indicated herein, the terms "first," "second," etc. are used merely as labels. These identifiers are not intended to impose hierarchical, ordinal, or positional requirements on the items to which these terms refer. Moreover, reference to a "first" feature or item does not require the existence of a "second" or higher-numbered item.

Unless otherwise indicated herein, the term "or" is inclusive. For example, a description of a device as including a first component or a second component should be understood to include devices including the first component without the second component, devices including the second component without the first component, and devices including both the first component and the second component.

As used herein, the description of a system, apparatus, device, structure, article, element, component, or hardware as being "configured to" perform a specified function is indeed capable of performing the specified function without any alteration, rather than merely having potential to perform the specified function after further modification. In other words, the system, apparatus, structure, article, element, component, or hardware "configured to" perform the specified function is specifically selected, created, implemented, utilized, programmed, and/or designed for the purpose of performing the specified function. Further, as used herein, the term "configured to" denotes existing characteristics of the system, apparatus, structure, article, element, component, or hardware which enable the system, apparatus, structure, article, element, component, or hardware to perform the specified function without further modification.

The present disclosure is related to a bedding securement system that is configured to limit the movement of one or more layers of bedding, such as sheets, blankets, comforters and duvets, that that are placed over a bedding surface, such as a mattress. By securing one or more layers of the bedding in place, potential shifting of the sheets and blankets can be reduced. The secured bedding thus helps keep the occupant of the bed comfortable and reduces the chance of the occupant from waking unnecessarily because they are cold or uncomfortable. Likewise, after the occupant rises, the secured bedding is already held in a convenient position for making the bed with limited effort.

Figure 1:
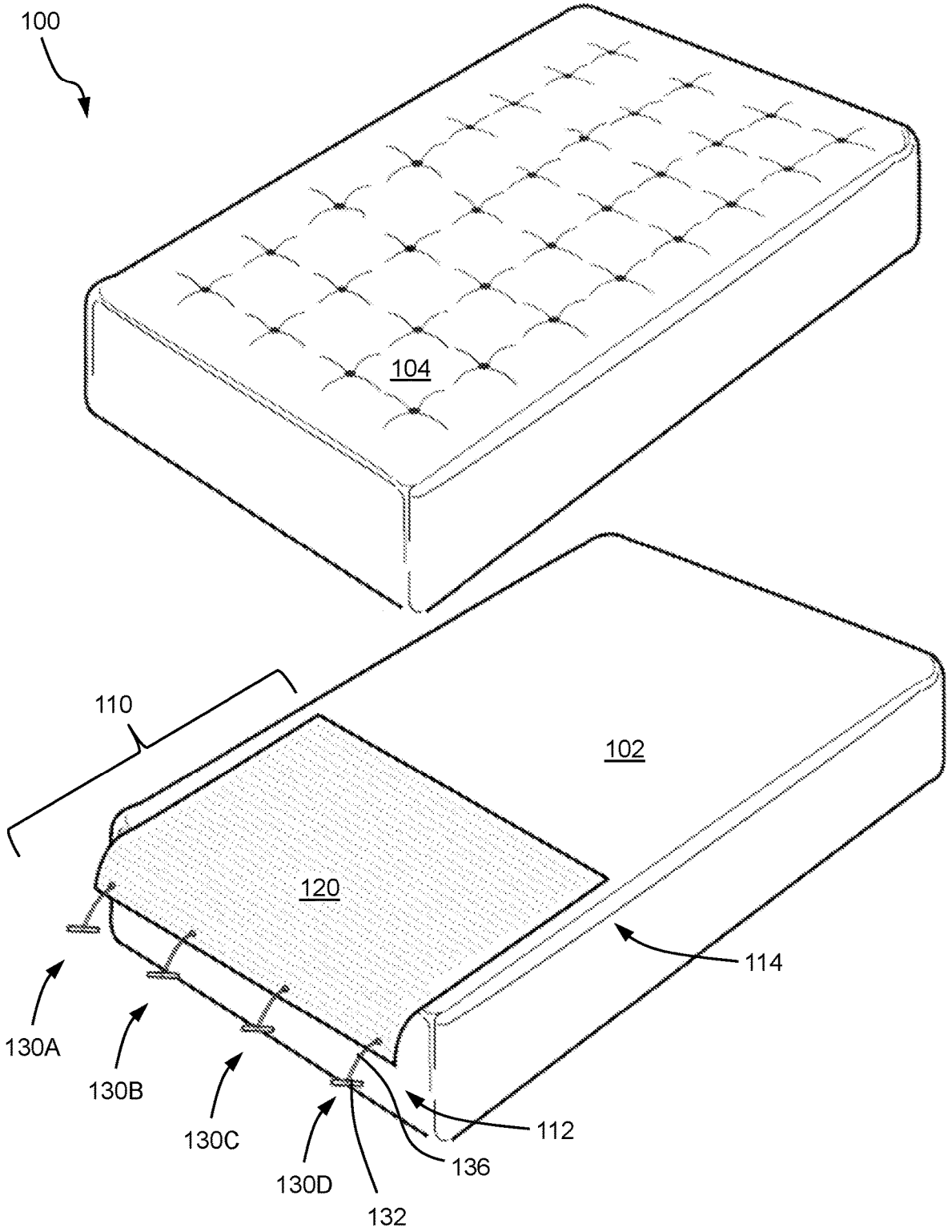
FIG. 1 is a schematic perspective view of a portion of a bedding securement system according to an embodiment of the disclosure.
Figure 2:
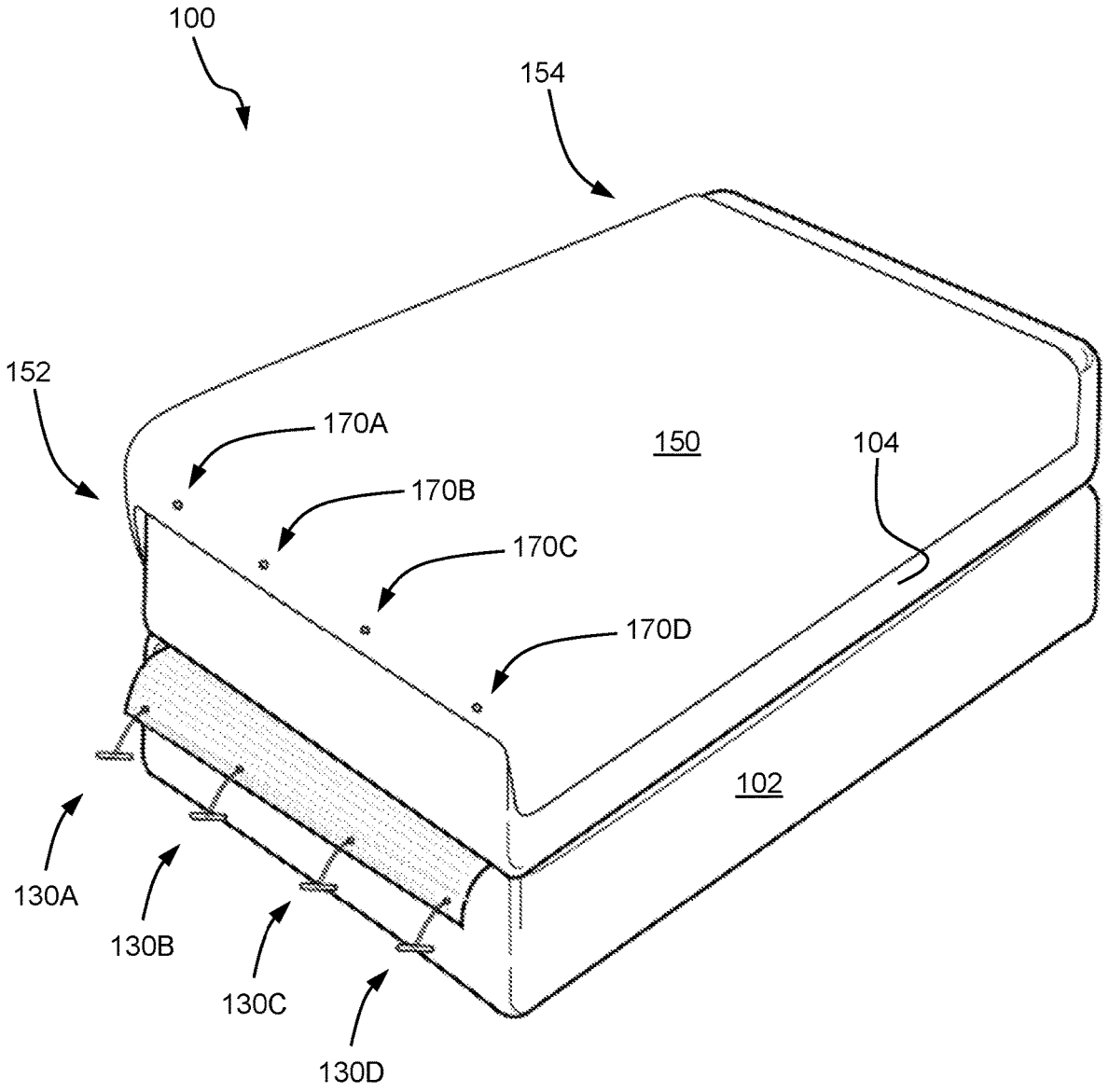
FIG. 2 is a schematic perspective view of the bedding securement system of FIG. 1.

With reference to the figures, FIGS. 1 and 2 show a bedding securement system 100. As shown in FIG. 1, the bedding securement system 100 may include a flexible base layer 110 that is placed on a support surface, such as box spring 102. The flexible base layer 110 may be configured to be positioned below a mattress 104 that rests on the support surface. The term mattress, as used herein may include various different sleeping surfaces, including inflatable mattresses, foam mattresses, spring mattresses, feather beds, foam pads, or other pads used as a sleeping surface. Likewise, while the configuration shown in FIGS. 1 and 2 shows the support surface as a box spring 102, the bedding securement system 100 can be used with various different surfaces, such as a floor, a bed platform, or another surface that holds a mattress.

The illustrated depiction of the flexible base layer 110 in FIG. 1 includes a bottom end 112 at the foot of the mattress 104 and a top end 114 that extends toward the head of the mattress 104. A plurality of anchoring fasteners 130A-130D may be positioned along the bottom end 112 of the flexible base layer 110.

As shown in FIG. 2, the bedding securement system 100 may also include a first bedding layer 150 configured to be positioned laid over the mattress 104. Like the flexible base layer 110, the first bedding layer 150 may include a bottom end 152 at the foot of the mattress 104 and a top end 154 that extends toward the head of the mattress. The first bedding layer 150 may include a plurality of first fasteners 170A-170D positioned along the bottom end 152 that are configured couple to the plurality of anchoring fasteners 130A-130D. With the anchoring fasteners 130A-130D and the first fasteners 170A-170D coupled to one another, movement of the first bedding layer 150 may be limited due to their attachment to the flexible base layer 110, which is held under the mattress 104.

In some embodiments, the flexible base layer may include a flat body, and each of the anchoring fasteners may be positioned toward the bottom end of the flat body. For example, in the embodiment shown in FIG. 1, the flexible base layer 110 includes a rectangular flat body 120 and the anchoring fasteners 130A-130D are secured to the flat body 120 in the vicinity of a bottom edge of the flat body.

In some embodiments, the flat body may be formed of fabric. For example, the flat body 120 of the flexible base layer 110 shown in FIG. 1 is formed of a rectangular sheet of fabric that is largely positioned on top of the box spring 102 but with a bottom end that is draped over the edge at the foot of the box spring 102. In other embodiments, the flat body may be formed of another flexible material, such as a plastic or rubber mat.

In some embodiments, the fabric of the flat body may be a gripping fabric. For example, in some embodiments, the flat body may be formed of a fabric with a relatively high surface roughness, such as felt or a synthetic leather. Forming the flat body of a gripping fabric can help retain the flexible base layer under the mattress. Further, in some embodiments, the surface of the flat body may include gripping elements, such as plastic or rubber projections or ribs that increase the surface friction of the flat body.

In some embodiments, the width of the mattress may greater than the width of the flexible base layer. For example, the width of the flexible base layer extends laterally across the flexible base layer in a direction perpendicular to the length of the flexible base layer, which extends from the top end to the bottom end. In the embodiment shown in FIG. 1, the width of the flexible base layer 110 is defined by the width of flat body 120 and is slightly narrower than the width of the mattress 104. Accordingly, the side edges of the flat body 120 are obscured from view underneath the mattress 104 during use, which creates a neat appearance. In other embodiments, the width of the flexible base layer may be greater than the width of the mattress. For example, in some embodiments, a portion of the flexible base layer may be configured to drape over the side edges of the mattress. For instance, the flat body of the flexible base layer may be configured to extend over the sides of the box spring and under the box spring. Similarly, in some embodiments, the flexible base layer may include straps that extend around the side edges of the mattress or the box spring. Further, in some embodiments, the flat body of the flexible base layer may be configured as a fitted sheet that is configured to be secured to a box spring below, or to be fitted upwards onto the mattress. Other possibilities where the flexible base layer is wider than the mattress are also possible.

In some embodiments, each of the anchoring fasteners of the flexible base layer is configured to couple to a respective one of the first fasteners of the first bedding layer. For example, the embodiment shown in FIGS. 1 and 2 includes four anchoring fasteners 130A-130D of the flexible base layer 110 and four first fasteners 170A-170D of the first fabric layer 150. Each of the anchoring fasteners 130A-130D couples to a respective counterpart of the first fasteners 170A-170D. For example, in some embodiments, the anchoring fasteners may include buttons and the first fasteners may be button apertures that extend through a section of the first bedding layer. For example, each of the anchoring fasteners 130A-130D shown in FIGS. 1 and 2 includes a button 132 (as identified with respect to anchoring fastener 130D) and each of the first fasteners 170A-170D includes a button aperture configured to receive one of the buttons. The term button, as used herein, refers to a fastener that is intended to pass through an aperture and is sized or oriented to inhibit removal of the button from the aperture, as would be understood by a person of ordinary skill in the art. The buttons may be formed from various different materials, include hard materials such as plastic, bone or metal, or soft materials, such as a knot or braided ball of string. Further, the buttons may be formed as round buttons, toggle buttons, frog fasteners, or similar button arrangements. In other embodiments, the fasteners may have another configuration, such as a snap, a buckle, a clip, a hook, or another configuration.

Figure 3:
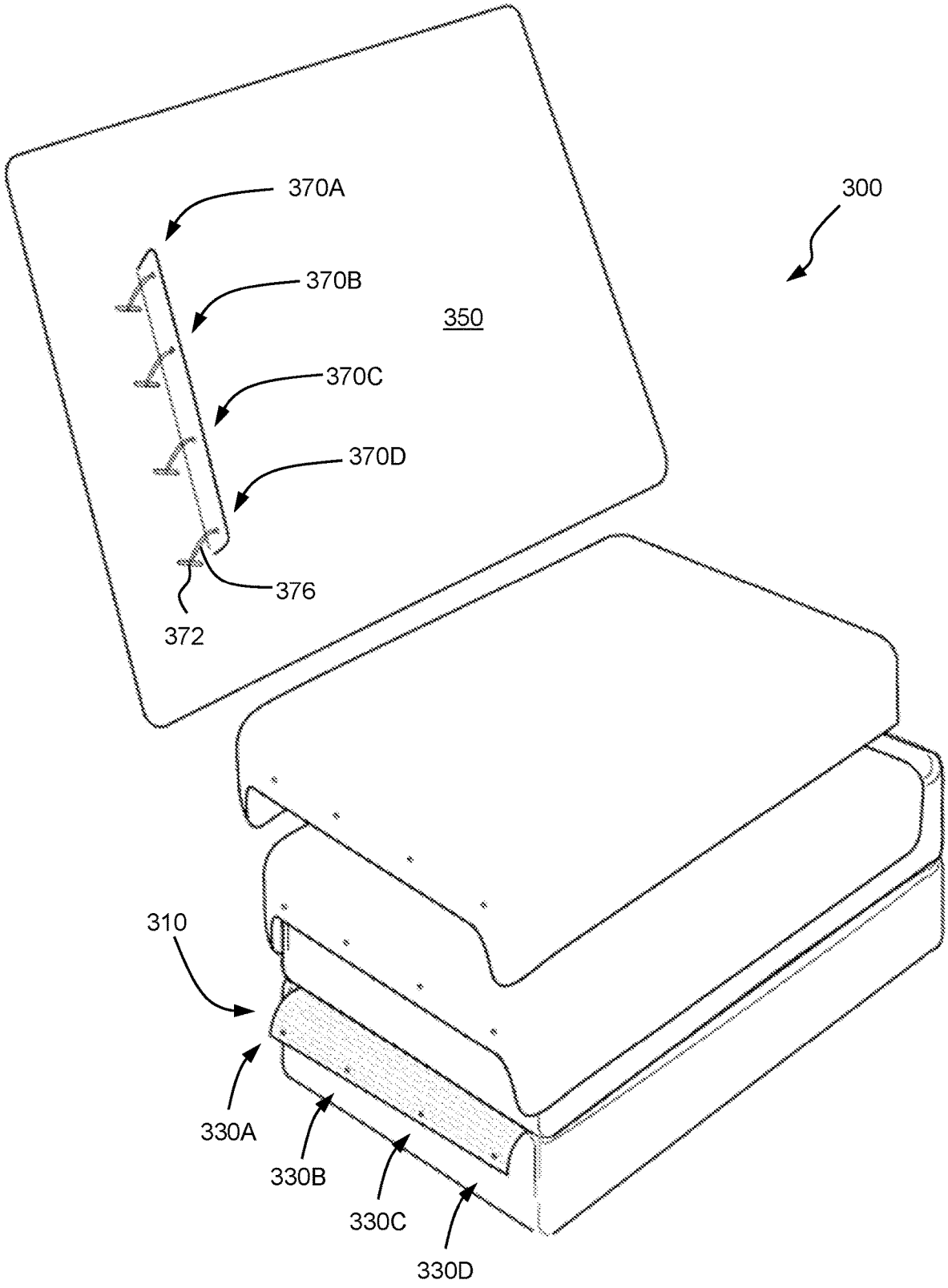
FIG. 3 is a schematic perspective view of a bedding securement system according to another embodiment of the disclosure.

In other embodiments, the first fasteners may include buttons and the anchoring fasteners may include apertures that receive the buttons. Such an embodiment is shown in FIG. 3. The bedding securement system 300 includes a flexible base layer 310 configured to be positioned under a mattress and a first bedding layer 350 configured to be positioned over the mattress. The first bedding layer 350 has first fasteners 370A-370D that include buttons 372 and the flexible base layer 310 has anchoring fasteners 330A-330D that are formed as button apertures that are configured to receive the buttons 372 of the first fasteners 370A-370D.

Still, in other embodiments, the anchoring fasteners and first fasteners may not directly pair with one another. For example, in some embodiments the first fabric layer may include twice the number of first fasteners as the numbers of anchoring fasteners of the flexible base layer. In such embodiments, the anchoring fasteners may each be configured to attach to two of the first fasteners. Or the anchoring fasteners may each be configured to attach to only one of the first fasteners, but the extra first fasteners provide flexibility for the user when coupling the first bedding layer to the flexible base layer. Further still, in some embodiments, the plurality of anchoring fasteners may be configured to collectively attach to the plurality of first fasteners, rather than individual discrete attachment. For example, in some embodiments the plurality of first fasteners may be tines of a zipper and the plurality of anchoring fasteners may also be corresponding tines of a zipper. In other embodiments the plurality of first fasteners may be elements of a strip of a recloseable fastener, such as hook and loop material, and the plurality of anchoring fasteners may be corresponding mating elements of the recloseable fastener.

In some embodiments, each of the anchoring fasteners may include a cord that extends from the flat body at the bottom end of the flexible base layer. For example, in the embodiment shown in FIG. 1, the flexible base layer 110 includes a rectangular flat body 120 and the anchoring fasteners 130A-130D include cords 136 (as identified with respect to anchoring fastener 130D) that extend from the flat body 120 at the bottom end 112 of the flexible base layer 110. A button 132 is secured to an end of each cord 136. Alternatively, in some embodiments, each of the first fasteners may include a cord that extends from the bedding material of the first bedding layer. For example, in the embodiment shown in FIG. 3, each of the first fasteners 370A-370D includes a cord 376 that extends from the material of the first bedding layer 350. Again, a button 372 is secured to an end of each of the cords 376. Still in some embodiments, both the first fasteners and the anchoring fasteners may include a cord where the ends of the cords are configured to attach to one another.

The cords may have any of various different constructions that form a tension line. For example, in some embodiments, the cords may include rope, string, cable or wire. Further, in some embodiments, the cords may include natural or synthetic fibers, metal, flexible plastic or other materials. Likewise, in some embodiments, the cords may be formed by a strip of fabric that extends from the flat body. Moreover, in some embodiments, the cords may be substantially elastic, such that the cords can change at least 20%, or at least 40% in length without deforming. Still, in some embodiments, the anchoring fasteners may be provided without any cords, as described further below.

Alternatively, in some embodiments, neither the anchoring fasteners nor the first fasteners include cords. For example, in some embodiments, the flat body of the flexible base layer is configured to extend to the first bedding layer and smaller anchoring fasteners, such as buttons secured directly to the flat body, are configured to be secured to the first bedding layer.

Figure 4:
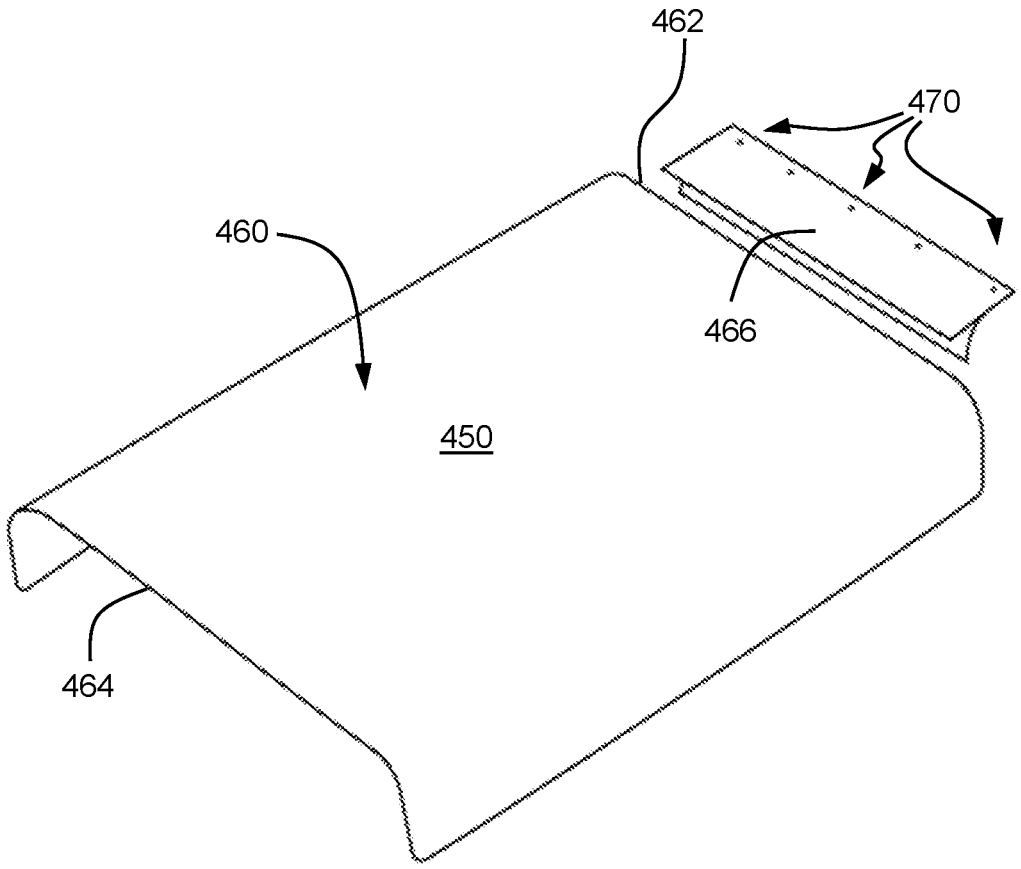
FIG. 4 is a schematic perspective view of a first bedding layer according to an embodiment of the disclosure.

In some embodiments, the first bedding layer may include a sheet of fabric, and wherein the button apertures extend through the sheet of fabric. For example, in the embodiment shown in FIG. 2, the first bedding layer 150 is a top sheet and the button apertures of the first fasteners 170 positioned directly in the body of the top sheet, such that a hole extends through the fabric of the top sheet. In other embodiments, the first bedding layer may include a sheet of fabric and an auxiliary flap attached to the sheet of fabric, where the button apertures may extend through the auxiliary flap. Such an embodiment is shown in FIG. 4. The first bedding layer 450 shown in FIG. 4 is configured as a top sheet including a body 460 formed by a sheet of fabric including a bottom edge 462 and a top edge 464. An auxiliary flap 466 may be attached to the bottom edge 462 of the sheet of fabric that forms the body 460 of the first bedding layer 450. The first fasteners 470 may be located on the auxiliary flap 466, as shown in FIG. 4, rather than directly in the body of the sheet of the fabric. Thus, to produce the first bedding layer, the first fasteners can be formed directly on the body of the material of the first bedding layer, such as by forming apertures through the material, or by attaching an auxiliary flap that incorporates the first fasteners.

In some embodiments, the auxiliary flap may be sewn to the first bedding layer. In other embodiments the auxiliary flap may be attached to the first bedding layer by other means, such as using pins or clasps.

Figure 5:
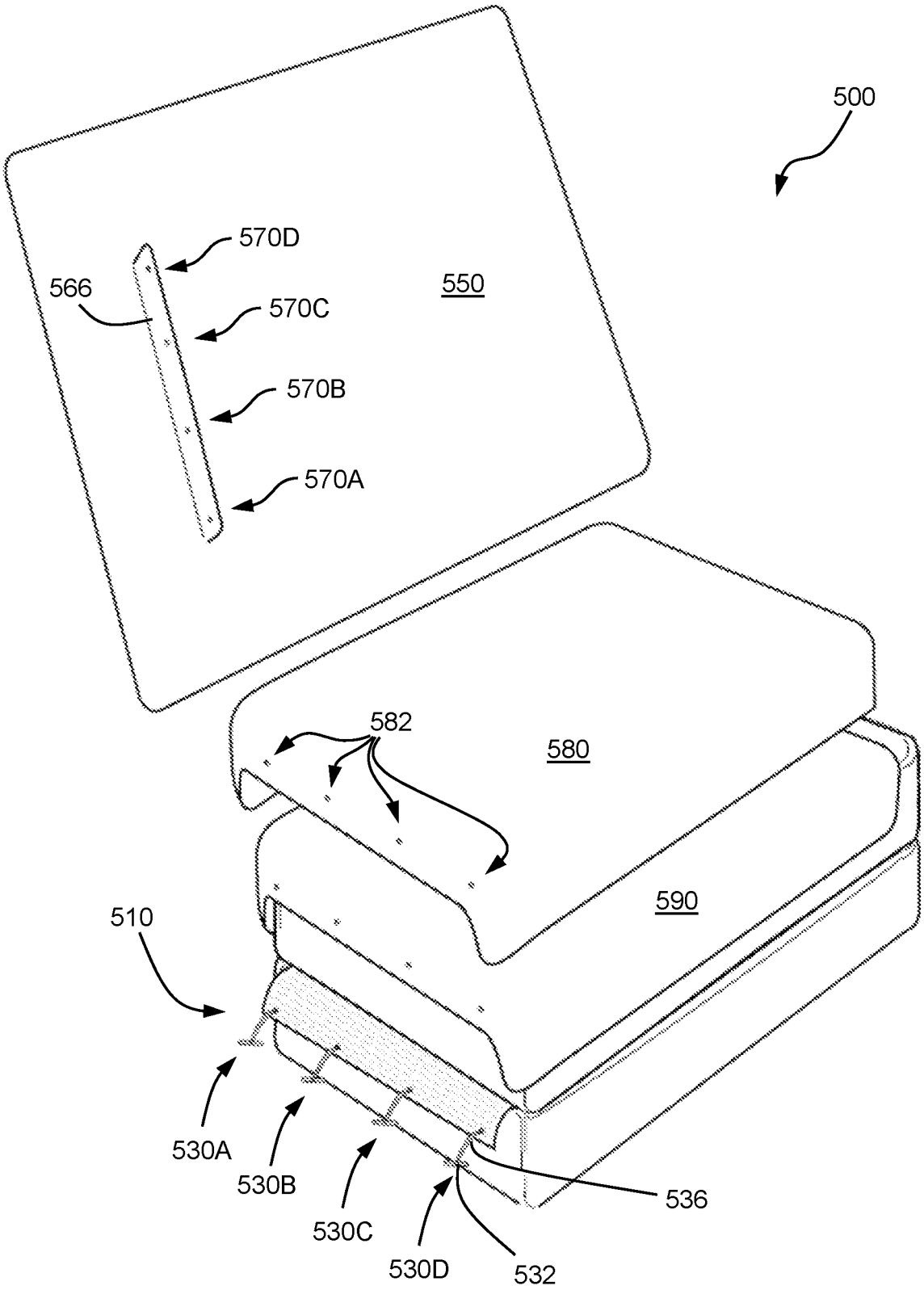
FIG. 5 is a schematic perspective view of a bedding securement system according to another embodiment of the disclosure.

In some embodiments, the auxiliary flap may be attached to the edge of the sheet of fabric, as in the first bedding layer 450 shown in FIG. 4. In other embodiments, the auxiliary flap may be attached to an interior surface of the sheet of fabric. FIG. 5 shows an example of such an embodiment. The bedding securement system 500 includes a flexible base layer 510 configured to be positioned under a mattress and a first bedding layer 550 configured to be positioned over the mattress. The first bedding layer 550 has first fasteners 570A-570D that include apertures and the flexible base layer 510 has anchoring fasteners 530A-530D that include cords 536 and buttons 532 configured to engage the apertures of the first fasteners 570A-570D. The apertures of the first fasteners 570A-570D are positioned in an auxiliary flap 566 that is secured to an interior surface of the sheet of fabric that forms first bedding layer 550.

The first bedding layer may be any of various types of bedding layers. For example, in some embodiments, the first bedding layer may include one sheet of fabric or textile material that is configured as a top sheet, a blanket, or a bedspread. In other embodiments, the first bedding layer may include two or more sheets of fabric or textile material that contain an insulating layer. For example, the first bedding layer may include a pocket formed by two sheets of fabric that hold an insulating layer therebetween. Such an embodiment may be configured as a comforter, quilt, duvet, duvet cover or other insulated bedding layer.

In some embodiments, the bedding securement system may include a second bedding layer configured to be disposed under the first bedding layer. The second bedding layer may include a top end, a bottom end, and a plurality of second fasteners disposed along the bottom end. The plurality of second fasteners of the second bedding layer may be configured to couple to the plurality of anchoring fasteners of the flexible base layer so as to limit movement of the second bedding layer with respect to the mattress. For example, the bedding securement system 500 shown in FIG. 5 includes a second bedding layer 580 and a third bedding layer 590 positioned between the mattress and the first bedding layer 550. The second bedding layer 580 includes a plurality of second fasteners 582 positioned along the bottom end of the second bedding layer 580. The second fasteners 582 are configured to be secured to the anchoring fasteners 530A-530D of the flexible base layer 510. For example, the first anchoring fasteners 530A-530D may be pushed through the second fasteners 582 of the second bedding layer such that the cord 536 of each anchoring fastener extends through the apertures of the second fasteners 582. The third bedding layer 590 may be similarly attached to the anchoring fasteners 530A-530D.

In other embodiments, the first fasteners may include cords, as described above with respect to the embodiment of FIG. 3, and the fasteners of second or third bedding layers may be secured to the first fasteners. For example, in such an embodiment, the cords of the first fasteners may extend through apertures in the second or third bedding layers.

While various aspects and embodiments have been disclosed herein, it will be apparent to those skilled in the art that various modifications and variations may be made to the devices and methods described here without departing from the scope of the disclosure. Accordingly, the present disclosure is intended to cover such modifications and variations of the disclosure, with the scope of the disclosure being set forth by the appended claims and their equivalents.

The invention claimed is:

1. A bedding securement system comprising:

a first bedding layer configured to be disposed over a mattress, the first bedding layer including a top end, a bottom end, and a plurality of apertures disposed along the bottom end, wherein the first bedding layer includes a sheet of fabric and an auxiliary flap attached to the sheet of fabric, and wherein the apertures of the first bedding layer are disposed on the auxiliary flap;

a second bedding layer configured to be disposed under the first bedding layer, the second bedding layer including a top end, a bottom end, and a plurality of apertures disposed along the bottom end; and a flexible base layer configured to be secured under the mattress, the flexible base layer including:

a flat body comprising a top end and a bottom end, and a plurality of anchoring fasteners disposed along the bottom end, each of the anchoring fasteners including a cord configured to pass through a respective aperture in the second bedding layer and a respective aperture in the first bedding layer such that the anchoring fasteners of the flexible base layer are configured to couple to the apertures of the first bedding layer and the apertures of the second bedding layer so as to limit movement of the first bedding layer and the second bedding layer with respect to the mattress.

2. The bedding securement system according to claim 1, wherein the flat body is fabric.

3. The bedding securement system according to claim 2, wherein the fabric is a gripping fabric.

4. The bedding securement system according to claim 1, wherein each of the anchoring fasteners of the flexible base layer is configured to couple to a respective one of the apertures of the first bedding layer.

5. The bedding securement system according to claim 1, wherein the auxiliary flap is sewn to the first bedding layer.

6. The bedding securement system according to claim 1, wherein the auxiliary flap is attached to an interior surface of the sheet of fabric.

7. The bedding securement system according to claim 1, wherein the auxiliary flap is attached to an edge of the sheet of fabric.

8. The bedding securement system according to claim 1, wherein the second bedding layer is a top sheet.

9. The bedding securement system according to claim 1, wherein the first bedding layer is a blanket or a bed spread.

10. The bedding securement system according to claim 1, wherein the first bedding layer includes a pocket to hold an insulating layer.

* * * * *